United States Patent [19]

Soga et al.

[11] Patent Number: 4,995,193

[45] Date of Patent: Feb. 26, 1991

[54] METHOD OF PREVENTING ADHERENCE OF ASH TO GASIFIER WALL

[75] Inventors: Kunio Soga; Kazuo Okada; Noriaki Tanaka; Morio Sogame; Toshio Tsujino, all of Yamaguchi, Japan

[73] Assignee: Ube Industries, Ltd., Ube, Japan

[21] Appl. No.: 553,632

[22] Filed: Jul. 18, 1990

[51] Int. Cl.[5] ..... C10J 3/46

[52] U.S. Cl. ..... 48/197 R; 48/202; 48/206; 48/DIG. 2; 48/DIG. 7; 252/373

[58] Field of Search ..... 48/197 R, 202, 206, 48/210, DIG. 2, DIG. 7; 252/373

[56] References Cited

U.S. PATENT DOCUMENTS

| | | | |
|---|---|---|---|
| 3,607,156 | 9/1971 | Schlinger et al. | 202/373 |
| 3,620,698 | 11/1971 | Schlinger et al. | 48/206 |
| 3,620,700 | 11/1971 | Schlinger et al. | 202/373 |
| 3,764,547 | 10/1973 | Schlinger et al. | 202/373 |
| 4,443,228 | 4/1984 | Schlinger | 48/DIG. 7 |
| 4,443,230 | 4/1984 | Stellaccio | 48/DIG. 7 |
| 4,657,702 | 4/1987 | Vasconcellos et al. | 202/373 |
| 4,705,536 | 11/1987 | Becker et al. | 252/373 |
| 4,857,229 | 8/1989 | Najjai et al. | 48/197 R |

*Primary Examiner*—Peter Kratz

*Attorney, Agent, or Firm*—Kanesaka and Takeuchi

[57] ABSTRACT

A method of preventing the adherence of the ash to a gasifier wall in a process for gasifying petroleum coke in the gasifier by partial oxidization reaction. The petroleum coke is mixed with 10 to 30 wt % of coal based on the petroleum coke and the mixture is gasified at a gasifying temperature higher than the melting point of the ash of said coal.

4 Claims, 2 Drawing Sheets

METHOD OF PREVENTING ADHERENCE OF ASH TO GASIFIER WALL

FIELD OF THE INVENTION AND RELATED ART STATEMENT

The present invention relates to a method of preventing the adherence of the ash to a gasifier wall when mixture of petroleum coke and coal is gasified.

A solid fuel such as coal and petroleum coke has conventionally pulverized to a slurry in a wet process adding water and the slurry obtained is gasified by the partial oxidization reaction with oxygen. It is known that since the volatile content of coal is 45 to 55% and the volatile content of petroleum coke is as low as 8 to 14%, the combustibility of petroleum coke is much lower than that of coal. It has been considered that when a mixture of coal and petroleum coke is gasified, coal which has a high combustibility hinders the combustion of petroleum coke which has a low combustibility, thereby further lowering the combustibility of petroleum coke.

For this reason, it is not in the prior art to mix petroleum coke with another solid fuel in an appropriate ratio and gasifying the mixture. That is, petroleum coke only is gasified. This method, however, is disadvantageous in that since the melting point of the ash of petroleum coke is ordinarily not lower than 1600° C., the ash adheres and deposits to and on the inner wall of a gasifier, thereby making long-term operation impossible. In addition, the combustibility of petroleum coke is not good and if the gasifying temperature is raised to improve the combustibility, the ash counted adhering to the wall further increases.

OBJECT AND SUMMARY OF THE INVENTION

Accordingly, it is an object of the present invention to eliminate the above-described problems in the related art and to provide a method of preventing the adherence of the ash to a gasifier wall which enables the reduction in the amount of unburned carbon and good long-term operation.

To achieve this aim, in the present invention, 10 to 30 wt % of coal is mixed with petroleum coke so that the ash of the petroleum coke flows downward together with the ash of the coal when the latter melts and flows down in the gasifier, thereby preventing the ash of the petroleum coke from adhering to the gasifier wall.

In the method of preventing the adherence of the ash to a gasifier wall according to the present invention, 10 to 30 wt % of coal is mixed with petroleum coke when the petroleum coke is gasified in a gasifier by partial oxidization, and the gasifying temperature is raised to a temperature higher than the melting point of the ash of the coal. The above ratio of 10 to 30% is that of coal to the total of the coal and the petroleum coke.

By gasifying a mixture of petroleum coke and coal in a gasifier at a temperature of 1,400° to 1,450° C., which is higher than the melting point of the ash of the coal, namely, 1,300° to 1,350° C., the ash of the coal melts and flows downward on the wall surface of the gasifier. The ash of the petroleum coke is caught by the melted ash of the coal and flows downward together therewith. These ash are cooled and solidified in a quench chamber and are taken out from the gasifier bottom in the form of slag.

Since the gasifying temperature is raised to 1,400° to 1,450° C., the combustibility of petroleum coke is improved. It is therefore possible to reduce the amount of unburned carbon on the petroleum basis (the amount of carbon obtained by subtracting the amount of carbon converted into a gas from the amount of carbon charged into the gasifier) to 4 to 9 wt % of the amount of carbon fed into the gasifier .

The above and other objects, features and advantages of the present invention will become clear from the following description of the preferred embodiment thereof, taken in conjunction with the accompanying drawings.

BRIEF DESCRIPTION OF THE DRAWINGS

FIGS. 1 and 2 show an embodiment of the present invention, wherein

FIG. 1 is a flowsheet suitable for carrying out the method according to the present invention; and FIG. 2 shows the relationship between the ratio of unburned carbon and the ratio of adhesion of ash to the mixing ratio of petroleum coke and coal.

DESCRIPTION OF THE PREFERRED EMBODIMENT

Figure 1:
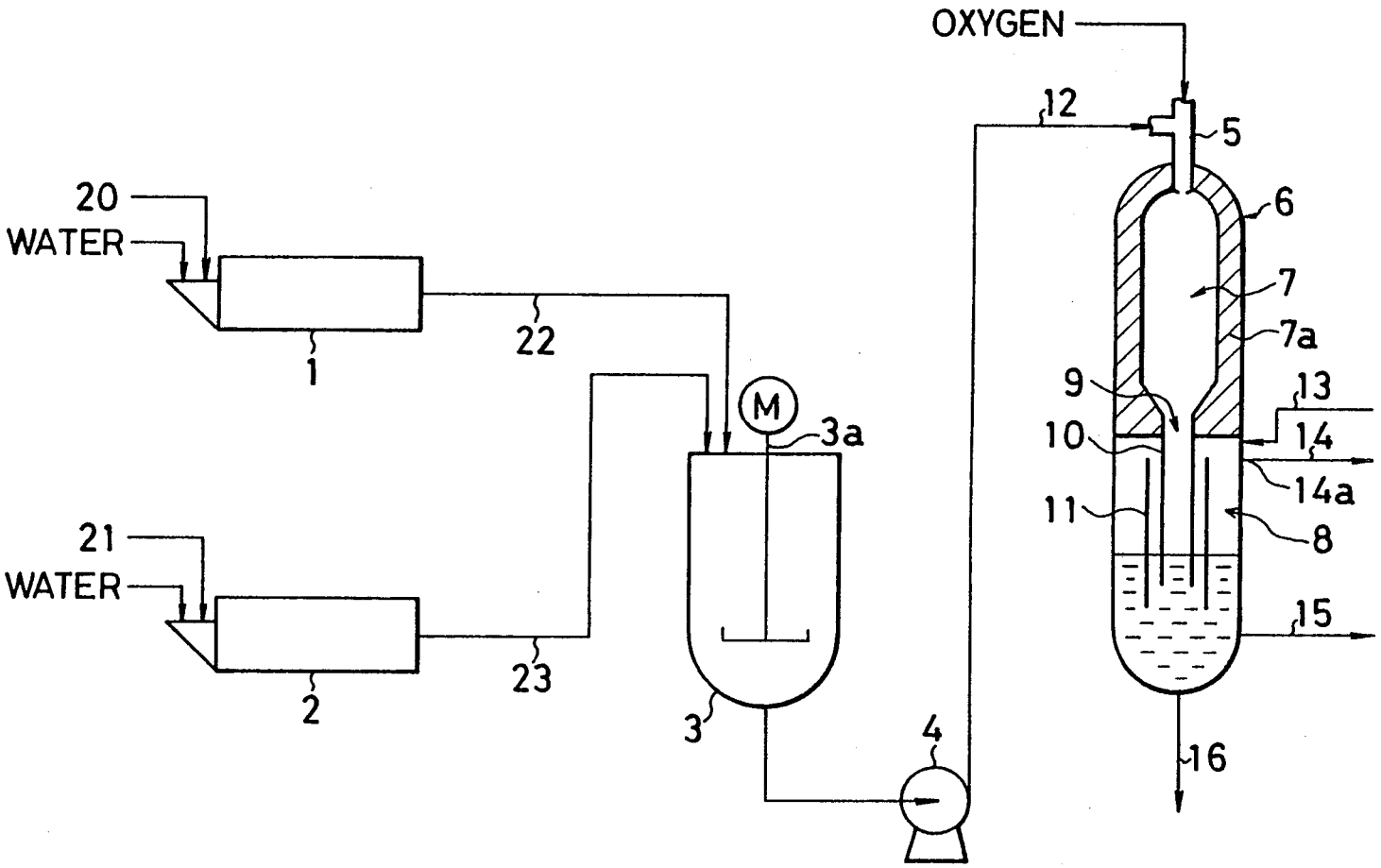
Figure 2:
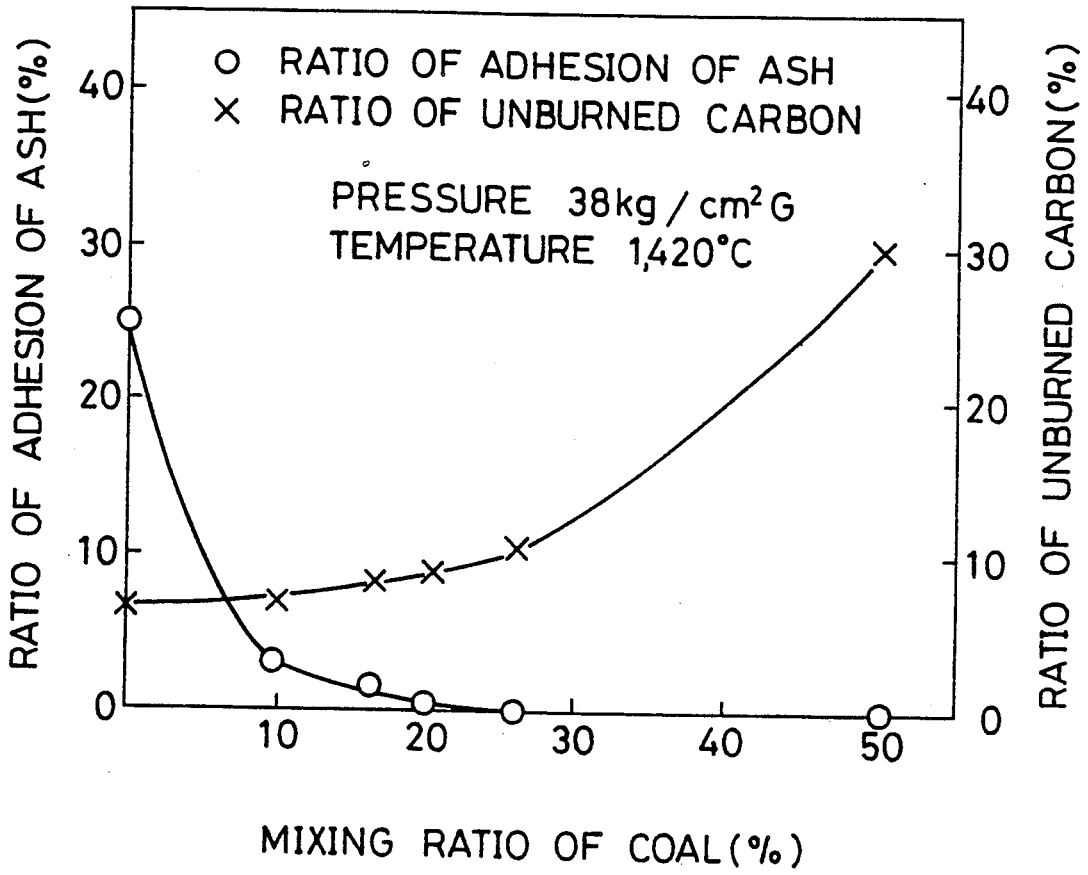

FIGS. 1 and 2 show an embodiment of the present invention, wherein FIG. 1 is a flowsheet suitable for carrying out the method according to the present invention, namely, what is called Texaco process for pulverizing a solid fuel into a slurry using a wet process and gasifying it by partial oxidization by oxygen. FIG. 2 shows the relationship between the ratio of unburned carbon and the ratio of adhesion of ash to the mixing ratio of petroleum coke and coal.

In FIG. 1, petroleum coke 20 (the melting point of the ash of the petroleum coke is about 1,800° C.) is charged into a pulverizer 1 together with an appropriate amount of water so as to be pulverized in a wet processes, and supplied to a slurry tank through a line 22 in the form of petroleum -water-slurry.

Coal 21 ((the melting point of the ash of the coal is about 1,350° C.) is charged into a pulverizer 2 together with an appropriate amount of water so as to be pulverized in a wet processes in the same way as in the case of the petroleum m coke 20, and supplied to a slurry tank through a line 23 in the form of coal-water-slurry.

The slurry tank 3 is equipped with a stirrer 3*a*, and the petroleum-water-slurry and the coal-water-slurry supplied from the pulverizers 1 and 2, respectively, are mixed with each other in the slurry tank 3 to form petroleum coke-coal-water-slurry. It is naturally possible to mix coal and petroleum coke in a predetermined ratio in advance, and pulverize the mixture into a slurry by one pulverizer.

The petroleum coke-coal-water-slurry is then supplied to a burner 5 through a line 12 and supplied to a gasifier 6 together with 40 to 60% of oxygen based on the theoretical amount of oxygen required for burning petroleum coke and coal, wherein it is gasified (partially oxidized) at a temperature of about 1,200° to 1,500° C. The pressure in the gasifier is preferably about 20 to 80 atm ($2.0\times10^6$ to $8.1\times10^6$ Pa).

The upper portion of the gasifier 6 is lined with a refractory 7*a* so as to form a reaction chamber 7. At the lower portion of the gasifier 6, a quench chamber 8 is provided. The reaction chamber 7 and the quench chamber 8 is connected with a throat 9. To the quench chamber 8, water for quenching is supplied from a line 13 to keep water level an appropriate height in the quench chamber 8. In the quench chamber 8, a cylindrical dip tubes 10 and a cylindrical draft tube 11 are coaxially provided such that the lower end portions thereof sink under the water.

The gas produced in the reaction chamber 7 passes the through the throat 9 and the dip tube 10 and is blown into the water within the quench chamber 8. Thereafter, the gas is fed to next facility (not shown) through a gas exhaust 14*a* provided above the water level and a line 14. When the gas is blown into the water in the quench chamber 8, the ash produced by the gasification of the mixed slurry of the petroleum coke 20 and the coal 21 and the unburned carbon are quenched by water, thereby becoming a fine slag and being caught by the water. The thus-produced slurry is taken out through a line 15 which is connected to the side wall of the quench chamber 8. From a line 16 at the bottom of the quench chamber 8, a slurry containing a comparatively coarse particle which are called coarse slag is taken out.

The prevention of the adherence of the ash to the gasifier wall during the gasification of a mixed slurry of petroleum coke and coal in the gasifier having the above-described structure will be explained hereinunder.

The case of gasifying petroleum coke only will first be explained. Petroleum coke contains 0.3 to 1 wt % of ash, and the ash contains trivalent vanadium.

The melting point of vanadium in a reducing atmosphere is 1,800° C., which is generally higher than the gasifying temperature for petroleum coke, namely, 1,200° to 1,500° C. Consequently, when the petroleum coke is gasified, the ash does not melt and adhere to the surface of the refractory 7*a* the reaction chamber 7, whereby the ash deposits. The lump of ash which has deposited and grown blocks the throat 9 of the gasifier 6.

As a countermeasure, a method may be considered of preventing the adherence of the ash to the gasifier wall by lowering the gasifying temperature to about 1,350° C. and the gasifying pressure to about 38 $kg/cm^2$ so as to reduce the reaction ratio of the carbon contained in the petroleum coke and produce a large amount of unburned carbon, thereby causing the ash to adhere to the unburned carbon.

Even this method, however, was not able to completely prevent the adherence of the ash to the gasifier wall although the ratio of adherence of the ash was reduced to some extent. On the other hand, the ratio of unburned carbon increased to 15 to 19 wt %.

In contrast, it was confirmed that when the gasifying temperature was 1,420° C. and the gasifying pressure was 38 $Kg/cm^2$ (about $3.8\times10_6$ Pa), if the mixing ratio of coal to petroleum coke was increased, the ratio of the adherence of the ash to the gasifier wall reduced in spite of the increase in the ratio of the unburned carbon. It was also confirmed that if the mixing ratio of coal was reduced, the ratio of the adherence of the ash content to the gasifier wall had a tendency to increase in spite of the reduction in the ratio of the unburned carbon.

Therefore, in the present invention, coal is mixed with petroleum coke in the ratio of 10 to 30 wt % of the coal to the sum of coal and the petroleum coke on the basis of the data shown in FIG. 2 so as both to prevent the adherence of the ash to the gasifier wall and to reduce the amount of unburned carbon when the petroleum coke is gasified.

When the mixing ratio of coal to petroleum coke is not less than 30%, no ash adheres to the gasifier wall, but the ratio of unburned carbon produced conspicuously increases.

The reason for this will be that since the volatile content of coal is 45 to 55% and the volatile content of petroleum coke is as low as 8 to 14%, the combustibility of petroleum coke is lower than that of coal, that when a mixture of coal and petroleum coke is gasified, coal which has a high combustibility hinders the combustion of petroleum coke which has a low combustibility, and that the amount of unburned coal generated increases with the increase in the mixing ratio of coal.

When the mixing ratio of coal to petroleum coke is not more than 10%, since the mixing ratio of coal is low, the amount of unburned carbon generated reduces without being influenced by the difference in the combustibility. However, since the amount of ash of coal is small, it is impossible to sufficiently catch the ash of petroleum coke, thereby increasing the amount of ash adhering to the gasifier wall.

In the above-described mixing ratio of coal to petroleum coke, it is assumed that the melting point of the ash of the coal is about 1,350° C. It is also possible to use coal having a melting point higher than 1,350° C. In this case, it is necessary to raise the temperature of the reaction chamber 7 to a temperature higher than the above-described gasifying temperature.

Although a mixture of petroleum coke and coal is gasified in the gasifier 6 in this embodiment, the present invention is not restricted thereto, and almost the same result is obtained from a mixture of petroleum pitch and coal.

The partial oxidization temperature in the reaction chamber in the present invention is preferably 30° to 100° C. higher than the melting point (T) of the ash of coal. That is, the temperature in the reaction chamber is preferably not lower than (T+30° C.) and not higher than (T+100° C.).

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A method of partially oxidizing petroleum coke and coal while preventing the adherence of the ash to the wall of a gasifier, said method comprising the steps of: pulverizing said petroleum coke and coal; introducing the pulverized petroleum coke, 10 to 30 wt % of coal based on said petroleum coke and oxygen in a smaller amount than the amount necessary for burning said petroleum coke and coal so as to partially gasify said petroleum coke and coal at a temperature higher than the melting point of the ash of said coal; blowing the gas produced during said partially oxidizing step to the water in a quench chamber through a throat and a dip tube in said gasifier; and taking out said gas which has passed through said water of said gasifier.

2. A method according to claim 1, wherein said petroleum coke and said coal are pulverized in a wet process into a slurry and the thus-obtained mixed slurry is supplied to said gasifier.

3. A method according to claim 1, wherein the partially oxidizing temperature is 30° to 100° C. higher than the melting point of the ash of said coal.

4. A method according to claim 1, wherein the amount of oxygen used for the partial oxidization is 40 to 60% of the theoretical amount of oxygen required for burning said petroleum coke and coal.

* * * * *